US005547509A

United States Patent [19]

Neider et al.

[11] Patent Number: 5,547,509

[45] Date of Patent: Aug. 20, 1996

[54] METHOD AND APPARATUS FOR CONTINUOUS SUPPORT OF A PAPER WEB THROUGH A COATING INSTALLATION

[75] Inventors: Thomas M. Neider, Washingtonville; Robert J. Rudt, Highland Mills, both of N.Y.

[73] Assignee: Champion International Corporation, Stamford, Conn.

[21] Appl. No.: 376,079

[22] Filed: Jan. 23, 1995

Related U.S. Application Data

[63] Continuation of Ser. No. 993,643, Dec. 21, 1992, abandoned.

[51] Int. Cl.[6] ..... B05C 1/08

[52] U.S. Cl. ..... 118/68; 118/126; 118/239; 118/250

[58] Field of Search ..... 118/65, 67, 68, 118/239, 249, 250; 162/265, 266, 900, 901; 198/847

[56] References Cited

U.S. PATENT DOCUMENTS

| | | | |
|---|---|---|---|
| 2,993,470 | 7/1961 | Stickel | 162/265 |
| 3,020,168 | 2/1962 | Gouveia | 118/239 |
| 3,245,378 | 4/1966 | Caple et al. | 118/126 |
| 4,526,637 | 7/1985 | Long | 198/847 |
| 4,928,622 | 5/1990 | Larsson et al. | 118/249 |

FOREIGN PATENT DOCUMENTS 460550 12/1913 France .

OTHER PUBLICATIONS

Translation of French Pat. No. 460,550, Dec. 1913.

*Primary Examiner*—Matthew O. Savage

[57] ABSTRACT

A coating installation is provided for a paper mill to apply a coating to at least one surface of a continuous web of paper. To reduce catastrophic damage to the web of paper passing through the coating installation, a continuous support belt is provided for supporting the web entirely through and beyond the location at which the coating is applied to the web. The continuous support belt is formed from a smooth dimensionally stable material exhibiting appropriate stiffness and compressibility for a particular coating application.

6 Claims, 2 Drawing Sheets

METHOD AND APPARATUS FOR CONTINUOUS SUPPORT OF A PAPER WEB THROUGH A COATING INSTALLATION

This is a division, of application number 07/993,643, filed Dec. 21, 1992, now abandoned.

BACKGROUND OF THE INVENTION

A paper mill converts wood, paper and/or byproducts thereof into a fibrous slurry. The slurry is treated and dried to form a continuous web. The web passes through a complex array of rolls and related apparatus at speeds in the range of 2,000–4,000 feet per minute to produce a continuous sheet of paper with appropriate dimensions, composition and surface characteristics. The paper typically is wound onto a large roll for shipment to other locations where the paper will be cut, folded, printed or the like for the intended end use of the paper.

Paper often will be coated on one or both sides to achieve a specified finish. The coating typically is applied in a prior art coating installation which may be part of a paper mill. The prior art coating installation may include an application roll and a backing roll disposed to define a nip therebetween. The prior art application roll may be partly submerged in a reservoir of a liquid coating material. Continuous rotation of the application roll transports some of the liquid coating material from the reservoir and onto a surface of the paper web passing through the nip. The prior art coating installation may further include a metering blade downstream from the nip and in contact with the surface of the paper web to which the coating has been applied. The metering blade removes excess coating liquid applied to the paper web. The coated web of material may then pass in proximity to driers which are operative to dry the liquid coating material applied to the web. Coating installations may be employed in tandem to sequentially coat opposed surfaces of the continuous web of material. The coating liquid applied at such tandem locations may be identical or different depending upon specifications for the paper.

Forces applied to the thin web passing rapidly through the nip in the prior art coating installation normally will not damage or break the fragile web. However, periodically defects in a paper web occur. These defects may be weaker then other parts of the web and can cause damage or breakage of the web. Such damage can be attributable to forces exerted in the actual nip, forces exerted by the metering blade or forces due to the abrupt changing of direction as the fragile wet web moves toward the coating driers. The breakage of the web passing through the prior art coating installation requires the entire coating installation to be shut down while the damaged web material is removed and while the paper web is rethreaded through the rolls. Even a short stoppage of the prior art coating installation is an inefficiency that can impose a very substantial cost penalty on the paper mill. It is estimated that as many as 150 breakages per month may occur in a prior art coater, and each breakage may take an hour to clear.

Another drawback of the prior art coating installation in a paper mill concerns the cost of equipment. In particular, the backing roll of the prior art coating installation must be manufacturing with great precision to ensure that a uniform surface is brought into contact with the re-wetted web of paper. The uniform surface typically is provided by a cover laminated onto the backing roll. The cover must exhibit a specified smoothness and resiliency and must withstand continuous exposure to heat and pressure without delamination. A properly covered backing roll is likely to cost about $400,000. These covered rolls often will be damaged by the heat, moisture, bleed through and pressure inevitably exerted thereon during the normal operation of the prior art coating installation. A damaged or worn backing roll must be replaced immediately to prevent excessive damage to the paper web being produced and to avoid long term shut down of the prior art coating installation in the paper mill. Consequently, most paper mills will include at least one spare backing roll. Thus, a typical prior art coating installation will have one $400,000 backing roll in use and at least one additional $400,000 backing roll sitting idle for use when needed. This clearly requires a substantial allocation of capital resources for even a large paper mill.

In view of the above, it is an object of the subject invention to provide a process for coating a paper web that lessens damage or breakage to the web of paper being coated, relative to that encountered on the prior art coating systems.

It is another object of the subject invention to provide a less expensive coating installation.

It is a further object of the subject invention to provide a coating installation that is less likely to damage the web of paper material being coated.

SUMMARY OF THE INVENTION

The subject invention is directed to a coating installation for applying a coating to a web of material. The coating installation may be part of a paper mill and may be operative to apply a liquid coating to one or both sides of a web of paper.

The coating installation may include a coating applicator in communication with a supply of coating material. The coating applicator may be an application roll that is continuously rotatably driven to apply the coating material to a paper web which passes in proximity to the application roll. The coating installation may further include a backing roll extending parallel to the application roll and in slightly spaced relationship thereto. Thus, the application roll and the backing roll may define a nip through which the paper web passes.

The coating installation of the subject invention further includes a continuous support belt rotatably mounted on a plurality of rolls and disposed to pass in proximity to the application roll or other such means for applying the coating. For example, embodiments of the coating installation having an application roll and a backing roll may have the continuous support belt passing through the nip between the application roll and the backing roll. Other embodiments may not include a backing roll, and may merely be provided with a support belt tensioned by other rolls of the coating installation to urge the web of material to be coated against the coating applicator roll.

The rolls for driving and supporting the continuous support belt may be disposed to engage the paper web prior to application of the coating to the web. The continuous support belt is further disposed to support the web after application of the coating thereto. For example, the continuous support belt may be disposed to support the coated web of material from the point of coating application to the coating driers. Thus, the web will be supported entirely through the stages of the coating installation in which the web is wet and/or most likely to be damaged.

The subject invention further is directed to a method for continuously supporting a web of material through a coating installation. The method comprises bringing a continuous support belt into contact with the web of material prior to application of a coating to the web. The method proceeds by applying a coating to a surface of the web that is supported by the continuous support belt and by maintaining continuous support for the web for a selected distance and/or a selected period of time to ensure that damage to the coated web is not likely to occur. For example, the continuous support for the coated web may be maintained at least until the web is in proximity to the coating driers.

The continuous support belt preferably is formed from a material that exhibits sufficient strength, dimensional stability, compressibility and smoothness. The belt may be formed from a woven or non-woven fabric substrate having a layer therein selected to provide an appropriate smoothness and compressibility to the continuous support belt. The belt may be porous or non-porous in accordance with the particular system in which the continuous support belt is employed, and may be steam permeable in either direction. Suitable materials for the belt may include polyurethane, synthetic rubber, natural rubber, nylon, polyethylene, polyethylene-terephthalate, or polycarbonate. The belt preferably defines a thickness of 100–500 mils, and most preferably 200–250 mils.

The apparatus and process of the subject invention offer several significant advantages over the prior art. For example, the continuous support belt of the subject invention provides support for the web of material when the web is most likely to be damaged and broken. Reducing breakage of the web will improve production rates. Additionally, the continuous support belt is substantially less expensive than the covered backing roll used at the coating installation of the prior art. In particular, a replacement belt can be purchased and installed for a fraction of the cost of a prior art covered backing roll.

DETAILED DESCRIPTION OF THE PREFERRED EMBODIMENT

Figure 1:
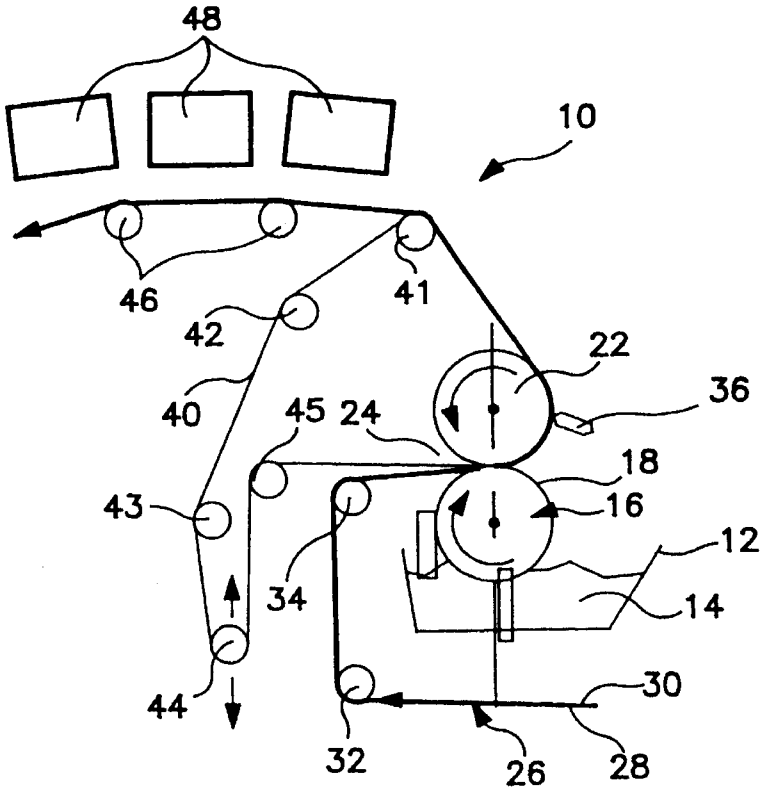
FIG. 1 is a schematic side elevational view of a coating installation of a paper mill incorporating the continuous support belt of the subject invention.

A coating installation in accordance with the subject invention is identified generally by the numeral 10 in FIG. 1. The coating installation 10 includes a reservoir 12 having a coating liquid 14 disposed therein. An application roll 16 is rotatably mounted such that a portion of the outer circumferential surface 18 thereof passes through the coating liquid 14. A backing roll 22 is aligned substantially parallel to the application roll 16 and extends substantially parallel thereto. The backing roll 22 is slightly spaced from the application roll 16 such that a nip 24 is defined therebetween.

A continuous web of paper 26 travels at a speed of 2,000–4,000 feet per minute in the direction of the arrows from a downstream location in a paper mill (not shown) and into the coating installation 10. The continuous web of paper 26 has opposed first and second sides 28 and 30 respectively. The web 26 travels around rolls 32 and 34 and into the nip 24 between the application roll 16 and the backing roll 22. As shown in FIG. 1, the center of axis of said backing roll and of said application roll are in vertical or substantially in vertical The web 26 is disposed such that the surface 30 thereof is brought into direct contact with the application roll 16. As noted above, the outer circumferential surface 18 of the application roll 16 passes through the coating liquid 14. A portion of the coating liquid 14 remains on the outer circumferential surface 18 of the application roll 16, and is brought into contact with the surface 30 of the web 26. The coating liquid 14 will thus wet the surface 30 of the web 26 passing through the nip 24. A metering device 36 is disposed in proximity to the application roll 16, and beyond the nip 24. The metering blade 36 is operative to remove excess coating liquid 14 from the surface 30 of the web 26, and to ensure that a substantially controlled amount of the coating liquid 14 remains on the surface 30 of the web 26. The metering blade 36 further ensures an even application of the coating liquid 14.

As noted above, the coating liquid 14 wets and weakens the web 26. As a result, a potential exists for damage or breakage of the web 26 after the coating liquid 14 is applied thereto. This breakage can occur due to the forces exerted on the web 26 passing through the nip 24, or as the wet web 26 traverses around the backing roll 22 and in proximity to the metering blade 36. As explained in detail above, such damage to the web 26 can result in substantial inefficiencies to paper coating processes.

The coating installation 10 illustrated in FIG. 1 avoids such damage to the web 26. More particularly, the coating installation 10 includes a continuous support belt 40 which travels at the speed of the web 26 around the backing roll 22 and through the nip 24 in supporting engagement with the continuous web 26. In particular, the continuous support belt 40 is supported and/or driven by rolls 41–45 which extend substantially parallel to and spaced from the backing roll 22. The disposition of the rolls 41–45 is such that the continuous support belt is substantially parallel and adjacent to the portion of the web 26 traversing from the drive roll 34 and into the nip 24. Thus, the continuous belt 40 supports the web 26 from a time prior to wetting of the web 26 with the coating liquid 14 and entirely through the nip 24. The belt 40 further supports the wet web 26 entirely around the backing roll 22 and in proximity to the metering blade 36. The continuous support belt 40 remains in supporting contact with the web 26 through to a location in proximity to the roll 41. The continuous support belt 40 separates from the web 26 in proximity to the roll 41. The web 26 then proceeds to be driven and supported by rolls 46 and may proceed to other rolls which are not shown in FIG. 1. Coating driers 48 are disposed in proximity to the surface 30 of the web 26 and in opposed relationship to the rolls 46. Thus, the coating liquid 14 applied to the surface 30 of the web 26 will be dried substantially as the web 26 is separated from the continuous support belt 40. The drying of the web 26 which is carried out by the coating dryers 48 effectively increases the strength of the web 26. Thus, the continuous support belt 40 efficiently supports the web 26 through portions of the coating installation 10 between the nip 24 and the coating driers 50 at which the web 26 is most susceptible to damage or breakage.

Paper grade specifications often require application of a coating to both sides of a web of paper. Coatings applied to the opposed sides may be identical or different in accordance with the particular specifications for the paper. The application of coating on opposed sides of a web of paper can be achieved with tandem coating installations disposed in proximity to one another. A first coating installation may be the coater 10 of FIG. 1 which will apply a coating to surface 30 of the web 26, while a tandem coating installation will apply a coating to the opposed side 28 of the web 26.

Figure 2:
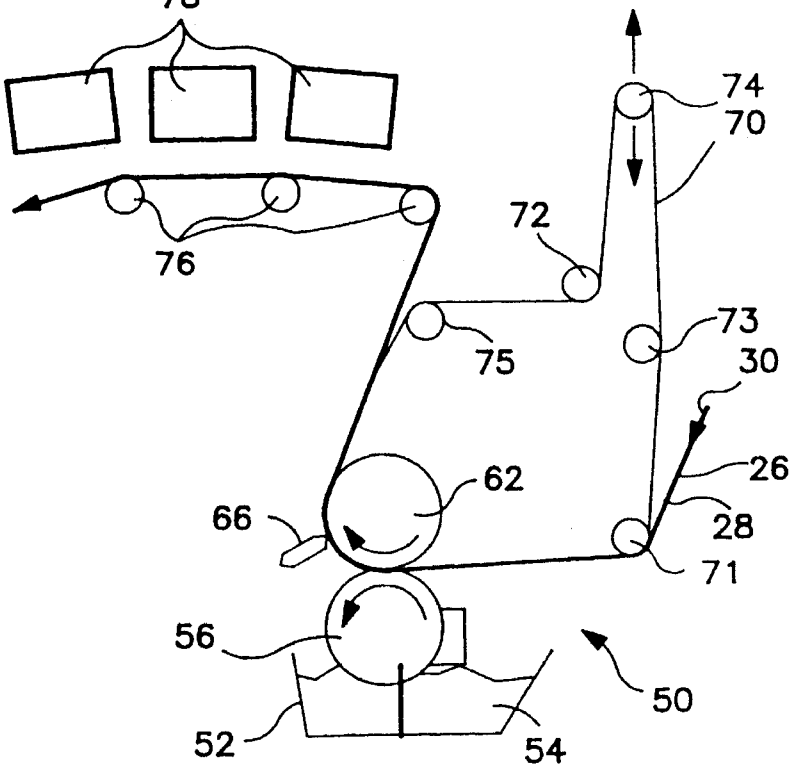
FIG. 2 is a schematic side elevational view of an alternate coating installation of a paper mill that may be used in tandem with the coating installation shown in FIG. 1.

FIG. 2 shows a coating installation 52 that may be used in tandem with the coating installation 10 of FIG. 1 to coat surface 28 of the web 26. The coating installation 50 includes a reservoir 52 having a supply of a coating liquid 54 therein. The coating liquid 54 may be the same as or different from the coating liquid 14. An application roll 56 is rotatably mounted such that an outer circumferential surface thereof passes through the coating liquid 54. A backing roller 62 is disposed in proximity to the application roll 56 such that a nip is defined therebetween. The web 26 passes from the coating installation 10 of FIG. 1 and toward the nip 64 of the coating installation 50 in FIG. 2. The web 26 is disposed such that the application roll 56 applies the coating liquid 54 to the surface 28 of the web 26.

A continuous support belt 70 supports the web 26 from a location prior to the entry of the web 26 into the nip 64 and to a point where the web 26 is well beyond the nip 64. More particularly, the continuous support belt 70 is supported and driven by rolls 71–75 disposed to efficiently support the web 26 and to prevent damage to the web 26 at the tandem coating installation 50. The continuous support belt 70 is separated from the web 26 at roll 75. Rolls 76 then guide the web 26 in proximity to the coating driers 78.

The continuous support belt 40 and/or 70 may have a fabric substrate with a coating on one or both opposed surfaces. The belt 40, 70 is formed from materials to exhibit appropriate smoothness, dimensional stability, cross-machine stiffness and compressibility. The belt may be manufactured to be porous or non-porous in accordance with requirements of a particular coating installation 10, 50. The belt 40, 70 may be made from a suitable rubber or elastomeric material, such as polyurethane, synthetic rubber, natural rubber, nylon, polyethylene, polyethyleneterephthalate or polycarbonate. The belt may define a thickness of between 100–500 mils, and most preferably defines a thickness of 200–250 mils. The substrate of the belt 40, 70, may be a non-woven mat of fibers laminated or coated on both sides or a scrim laminated or coated on both sides. Examples of agents incorporated into the belt for imparting appropriate smoothing, glossing or release type properties for the web 26 include: waxlike polymers, silicones, plasticizers, release agents and PTFE.

Figure 3:
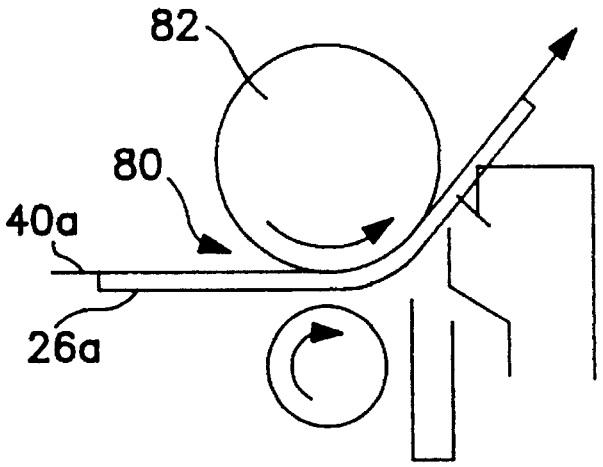
FIG. 3 is a side elevational view of a short-dwell blade type coater incorporating the continuous support belt of the subject invention.
Figure 4:
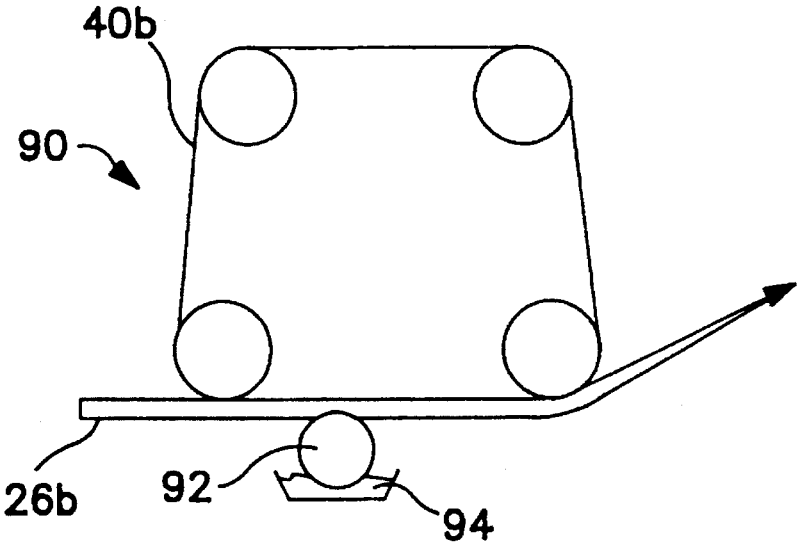
FIG. 4 is a side elevational view of a coating installation employing the continuous support belt of the subject invention without a backing roll.

The continuous support belt may be used in coating installations other than those shown in FIGS. 1 and 2. For example, FIG. 3 shows a short-dwell blade type roller 80 with a continuous support belt **40*a* traversing around a backing roller 82. The web 26*a* is supported entirely through the short-dwell blade type roller 80 by the continuous support belt 40*a*. FIG. 4 shows a coating installation 90 with an application roll 92 for applying a coating liquid 94 to a web 26*b*. A continuous support belt 40*b* supports the web 26*b* in proximity to the application roll 92. However, no backing roll is provided in the coating installation 90 of FIG. 5**.

While the invention has been described with respect to certain preferred embodiments, various changes can be made without departing from the scope of the invention as defined by the appended claims. For example, a continuous support belt may be employed for supporting a continuous web of paper through coating stations other than the few preferred embodiments depicted herein. Additionally, the configurations of rolls for supporting and driving the continuous support belt may be varied from the illustrated embodiments. These and other variations will be apparent to a person skilled in the art after having read the subject disclosure.

We claim:

1. A coating installation for coating a continuous web of paper moving through said installation at a selected speed, said web of paper having opposed first and second surfaces, said coating installation comprising:

driving means for driving the web of paper through said installation;

a continuous support belt having a portion adapted to be disposed in supporting engagement with a portion of the second surface of the web of paper driven through said installation;

a supply of liquid coating material;

delivering means for delivering coating material from the supply to the first surface of the web of paper driven through said installation to form a coating of said material on said first surface, wherein the means for delivering the coating to the web includes an application roll having an outer circumferential surface communicating with the supply of coating liquid, the application roll being rotated such that the outer circumferential surface thereof is brought into contact with the first surface of the web, the coating installation further comprising a backing roll extending substantially parallel to and slightly spaced from the application roll thereby forming a nip therebetween, the backing roll being disposed such that the continuous support belt is intermediate the second surface of the web of paper and the backing roll;

driving means for driving the continuous support belt substantially at the speed of the web of paper being driven through said installation, wherein said driving means includes a plurality of drive rolls that are substantially parallel to and spaced from said backing roll for supporting and driving said continuous support belt;

metering means separate from and spaced downstream from said delivering means for removing excess coating material from said first surface of a web of paper supplied by said delivering means to form a uniform or substantially uniform coating of a predetermined thickness on the surface of the web, wherein the metering means is positioned in proximity to the application roll and beyond the nip;

wherein said support belt is configured and arranged to continuously support the web of paper in proximity to the metering means and the delivery means; and, drying means for drying said coating of liquid coating material, said drying means positioned downstream of said metering means and wherein said web of paper separates from said continuous support belt in proximity to said drying means.

2. The coating installation as in claim 1, wherein said continuous support belt is configured and arranged to separate from said web of paper at said drying means.

3. The coating installation as in claim 1, wherein said continuous support belt is configured and arranged to separate from said web of paper at a position upstream of said drying means.

4. The coating installation of claim 1, wherein the center of axis of said backing roll and of said application roll are in vertical or substantially in vertical alignment with respect to each other.

5. The coating installation of claim 1, wherein said speed of the web of paper of from about 2,000 to about 4,000 feet per minute.

6. A coating installation for coating a continuous web of paper moving through said installation at a selected speed, said web of paper having opposed first and second surfaces, said coating installation comprising:

a said web of paper;

driving means for driving the web of paper through said installation;

a continuous support belt having a portion adapted to be disposed in supporting engagement with a portion of the second surface of the web of paper driven through said installation;

a supply of liquid coating material;

delivering means for delivering coating material from the supply to the first surface of the web of paper driven through said installation to form a coating of said material on said first surface, wherein the means for delivering the coating to the web includes an application roll having an outer circumferential surface communicating with the supply of coating liquid, the application roll being rotated such that the outer circumferential surface thereof is brought into contact with the first surface of the web, the coating installation further comprising a backing roll extending substantially parallel to and slightly spaced from the application roll thereby forming a nip therebetween, the backing roll being disposed such that the continuous support belt is intermediate the second surface of the web of paper and the backing roll;

driving means for driving the continuous support belt substantially at the speed of the web of paper being driven through said installation, wherein said driving means includes a plurality of drive rolls that are substantially parallel to and spaced from said backing roll for supporting and driving said continuous support belt;

metering means separate from and spaced downstream from said delivering means for removing excess coating material from said first surface of a web of paper supplied by said delivering means to form a uniform or substantially uniform coating of a predetermined thickness on the surface of the web, wherein the metering means is positioned in proximity to the application roll and beyond the nip;

wherein said support belt is configured and arranged to continuously support the web of paper in proximity to the metering means and the delivery means; and, drying means for drying said coating of liquid coating material, said drying means positioned downstream of said metering means and wherein said web of paper separates from said continuous support belt in proximity to said drying means.

* * * * *